US005294127A

United States Patent [19]

Keelan

[11] Patent Number: 5,294,127

[45] Date of Patent: Mar. 15, 1994

[54] WEIGHTED GOLF CLUBS COVERS

[76] Inventor: Regis T. Keelan, 54 Lakefront, Irvine, Calif. 92714

[21] Appl. No.: 29,824

[22] Filed: Mar. 11, 1993

[51] Int. Cl.[5] ..... A63B 69/36; A63B 57/00

[52] U.S. Cl. ..... 273/194 B; 150/160; 482/109; 482/148; 273/162 R

[58] Field of Search ..... 273/194 R, 194 A, 194 B, 273/162 R, 32 R, 60 B, DIG. 20; 150/160, 159; 482/109, 148

[56] References Cited

U.S. PATENT DOCUMENTS 3,398,961 8/1968 Higdon ..... 273/194 B
3,478,799 11/1969 Hoyt ..... 150/160
4,238,537 12/1980 Kerr ..... 273/60 B X
4,836,552 6/1989 Puckett et al. ..... 273/DIG. 20

*Primary Examiner*—George J. Marlo
*Attorney, Agent, or Firm*—Price, Gess & Ubell

[57] ABSTRACT

A weighted cover for the head of golf club is made from a mixture of plastic and a filler and includes an inner cavity having an entrance thereto for receiving the club head. Besides protecting the golf club head from the elements and nicks and scratches, the weighted covers securely fit on the club head and add a predetermined amount of mass uniformly around the club head, thereby retaining the club's effective center of gravity, even during practice swings of the golf club.

12 Claims, 3 Drawing Sheets

WEIGHTED GOLF CLUBS COVERS

BACKGROUND OF THE INVENTION

1. Field of the Invention

The present invention relates to weighted golf club covers and, more particularly, pertains to golf club covers made from plastic and fillers, and a process for making such covers.

2. Description of Related Art

The art is generally cognizant of golf club covers and golf club covers that include a weight. Representative prior art in the field of golf club covers is included below.

M. A. Higdon, U.S. Pat. No. 3,398,961, teaches that a golf club cover can be used to secure a weight over the club's hitting surface, or club face.

D. G. Hoyt, Jr., U.S. Pat. No. 3,478,799, discloses a one-piece plastic slipover cover for the head of a golf club iron.

As ancient as the game of golf is, its many enthusiasts are still deprived of a convenient, well-fitting swing weight which does not distort the "feel" of the club. Existing golf club covers fail to satisfy the needs of golfers in several respects. Covers made of a low density material, such as plastic, are too light to sufficiently exercise and thereby recondition a golfer's muscles, as is the basic objective of practice swinging with mass added to the club head. Other covers secure a piece of metal to the hitting surface, or face, of the golf club. Such covers must be tied, strapped, buckled, or otherwise secured to the club head to prevent the piece of metal from slipping off the club head and pulling the cover with it during practice swinging. Moreover, such covers substantially change the club head's effective center of gravity when attached. As a result, a golfer loses the "feel" of his club when such a practice weight is used.

OBJECTS AND SUMMARY OF THE INVENTION

An object is to provide a weighted cover that fits snugly over the head of a golf club and remains secured to the golf club's head while the player is swinging the club.

Yet another object is to provide a golf club cover weight which does not change the golf club's effective center of gravity when the golf club cover weight is secured to the club's head.

Still another object of the present invention is to provide a process for inexpensively and effectively manufacturing the weighted golf club cover.

The golf club cover weights are made from a mixture of plastic and filler and are shaped such that they fit snugly over the head of a golf club. The density and, hence, the weight, of the golf club cover is controlled by adjusting the ratio of plastic to filler in the mixture. The mixture of plastic and filler is uniform throughout the golf club cover weight. The actual weight of an individual golf club cover is dependent upon the aforementioned ratio, the size of the golf club cover weight, the thickness of the golf club cover, and the materials chosen for the plastic and the filler. Examples of materials sufficiently dense to be fillers include lead, iron, zinc, barium, aluminum, bronze, and stainless steel. Plastics appropriate for the manufacture of the golf club cover weights include thermoplastics and thermosetting plastics. More specifically, a polyolefin, polyethylene, polypropylene, polyvinylchloride, ethylene vinyl acetate, or polyurethane are suitable. The golf club cover weights can be formed by injection blow molding, extrusion blow molding, slush casting, and injection molding. A set of golf club cover weights may be assembled from a group of golf club cover weights varying in size, wherein each such golf club cover weight is sized to fit a different golf club in a set of golf clubs. The weight of each such golf club cover weight, which is evenly distributed therethrough by virtue of the methods by which said golf club cover weights are manufactured, may vary to accommodate the particular needs of different golfers.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

Figure 1:
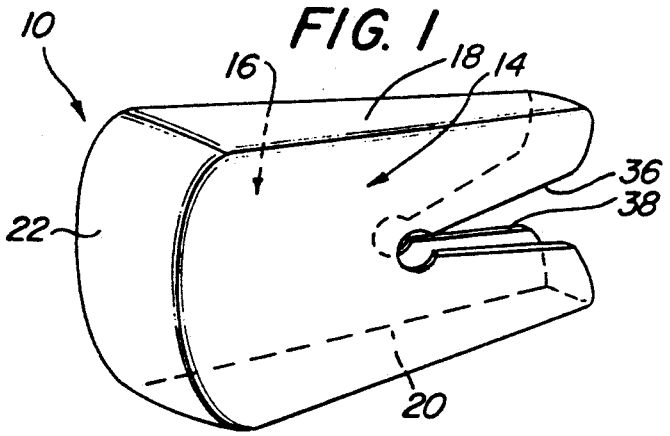
FIG. 1 is a schematic perspective showing a weighted cover for an iron.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide weighted golf club covers made from a mixture of plastic and filler and a process for the making thereof.

FIGS. 1–5 show a weighted golf club cover 10 for an iron 40. Similarly, FIGS. 6–10 show a weighted cover 50 for a driver 80. Weighted iron cover 10 includes a cavity and an entrance thereto designed to receive the iron head 42 of an iron 40 and fit snugly thereabout so that iron cover 10 will not slip off while the golfer practice swings iron 40. Likewise, weighted driver cover 50 fits securely about the driver head 82 of a driver 80 so that driver cover 50 will not slip off during practice swinging.

Weighted covers 10, 50 are made of a uniform mixture of plastic and filler (i.e., a filled plastic). Filler is chosen from materials with higher densities, such as metals. Accordingly, weighted covers 10, 50 are sufficiently heavy to serve as practice weights.

An advantage of weighted covers 10, 50 is that they are simple to use. Specifically, covers 10, 50 are designed to stay secured to the head of the club over which they are fitted. Hence, there is no need for ties and/or straps to secure weights 10, 50 to iron 40 and driver 80, respectively. The additional mass that weighted covers 10, 50 add to the head of a golf club accelerates the redevelopment of "golfing muscles" which have degenerated or become weak for lack of practice, or effectively developing muscle memory. Practice swinging with a heavier golf club loosens, exercises, and develops the aforementioned muscles and their memory.

Ideally, a golfer swinging a weighted practice club would like to keep the "feel" of the club, notwithstanding the fact that the club is heavier. More specifically, the club head's center of gravity for any particular golf club should remain substantially the same even after a practice weight has been added. Accordingly, weighted covers 10, 50 are advantageous in that they provide a cover for practice swinging that adds sufficient mass to the club head without unduly distorting the club head's effective center of gravity or "feel."

Figure 3:
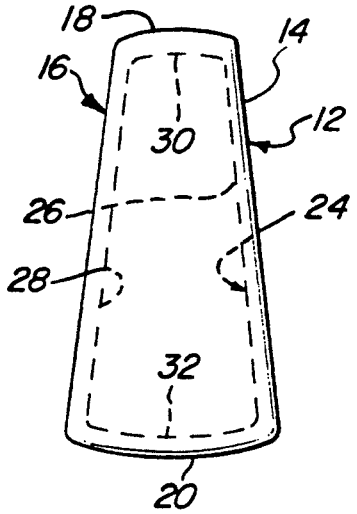
FIG. 3 is an end view of a weighted cover for an iron.
Figure 2:
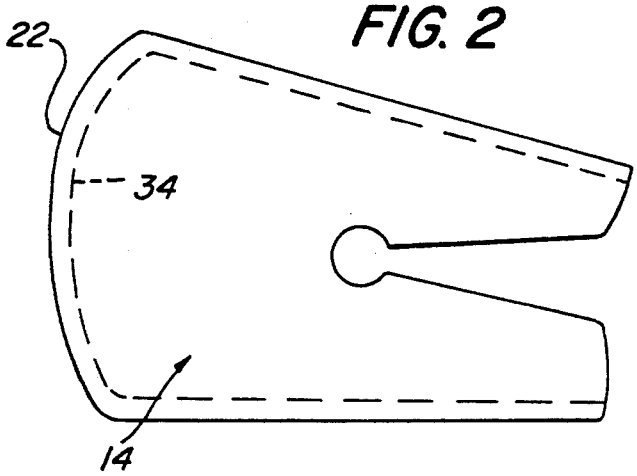
FIG. 2 is a front view of a weighted cover for an iron.
Figure 4:
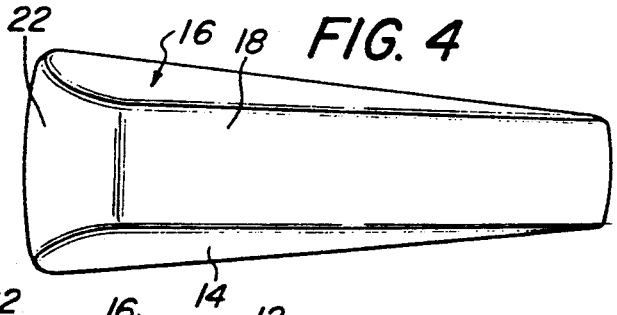
FIG. 4 is a top view of a weighted cover for an iron.
Figure 5:
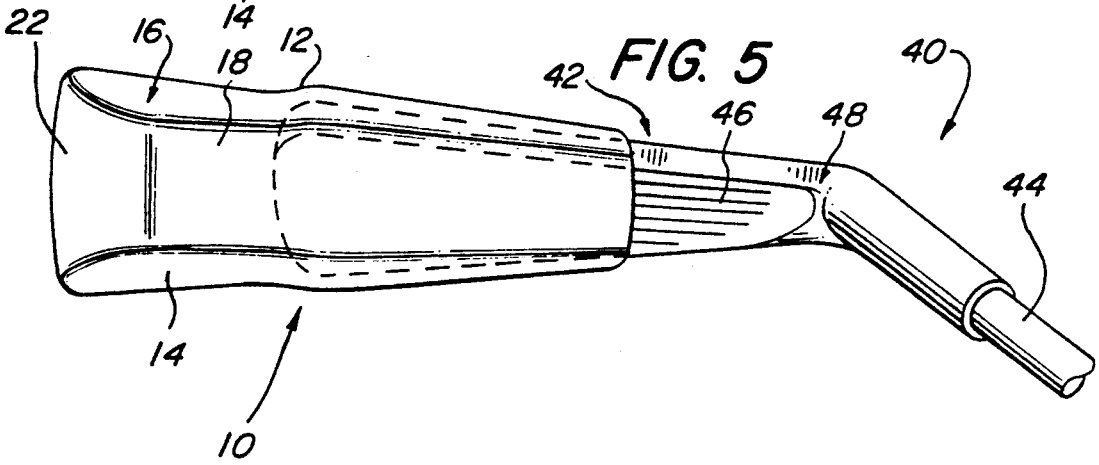
FIG. 5 is a top view of a weighted cover such as in FIGS. 1–4 with an iron being inserted therein.

Weighted iron cover 10 has an iron cover exterior surface 12 and an iron cover interior surface 24 defining a cavity. As FIGS. 2 and 3 illustrate, iron cover exterior surface 12 includes iron cover forward exterior surface 14, iron cover rear exterior surface 16, iron cover top exterior surface 18, iron cover bottom exterior surface 20, and iron cover end exterior surface 22. Similarly, iron cover interior surface 24 includes iron cover forward interior surface 26, iron cover rear interior surface 28, iron cover top interior surface 30, iron cover bottom interior surface 32, and iron cover rear interior surface 34. FIG. 5 shows golf club iron 40 being inserted into weighted iron cover 10. Iron 40 includes head 42, which is attached to shaft 44. Head 42, in turn, is characterized by hitting surface 46 and rear surface 48.

When iron 40 is inserted into cover 10, the hitting surface 46 abuts cover forward interior surface 26. Since the rear surface 48 is somewhat curved as compared to its hitting surface 46, iron cover rear interior surface 28 is correspondingly curved to accommodate receipt of iron 40 into iron cover 10, or it can accommodate such curvature because the cover material is somewhat pliable.

Iron cover 10 includes iron cover forward slot 36 and iron cover rear slot 38 which, in combination with the fact that iron cover 10 is preferably made of a flexible material, allow iron 40 to be inserted therein. Forward slot 36 is a channel in iron cover weight 10, as is illustrated in FIGS. 1 and 2. Forward slot 36 is bounded by iron cover forward exterior surface 14 and iron cover forward interior surface 26. Similarly, rear slot 38 is a channel on the opposite side of iron cover 10 and is bounded by iron cover rear exterior surface 16 and iron cover rear interior surface 28. Forward slot 36 and rear slot 38 permit expansion of iron cover 10 during insertion of iron 40 into iron cover 10. Such an expansion of iron cover 10 to receive an iron 40 is possible because iron cover 10 is made of a sufficiently flexible material. FIGS. 1 and 2 further illustrate the preferred shape of forward slot 36 and rear slot 38. Such a shape enables weighted iron cover 10 to receive iron 40 and to secure weighted iron cover 10 to iron 40 during practice swinging.

Figure 7:
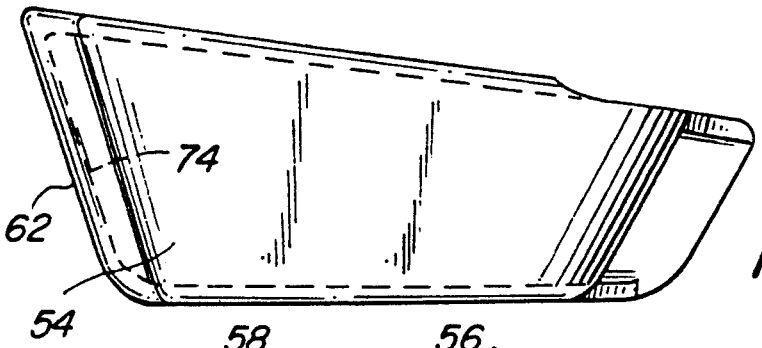
FIG. 7 is a front view of a weighted cover for a wood.
Figure 9:
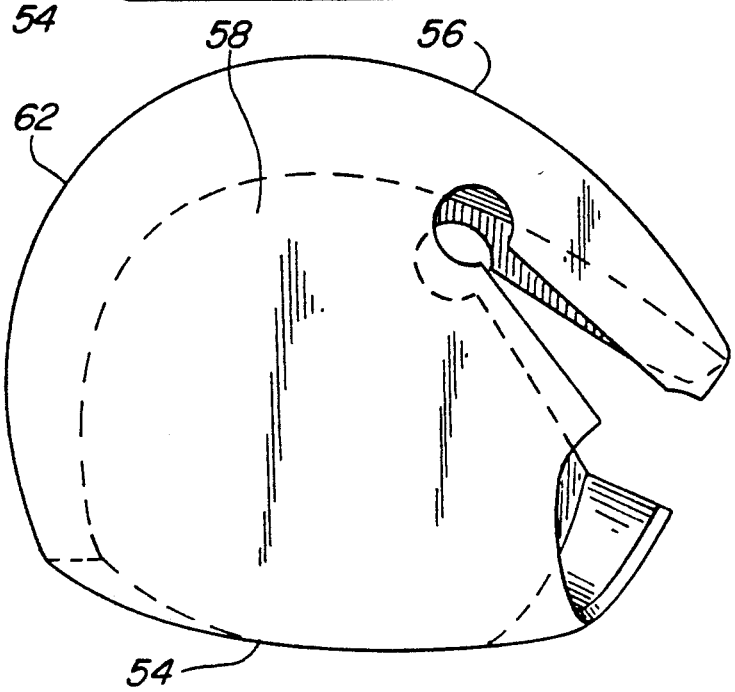
FIG. 9 is a top view of a weighted cover for a driver.
Figure 8:
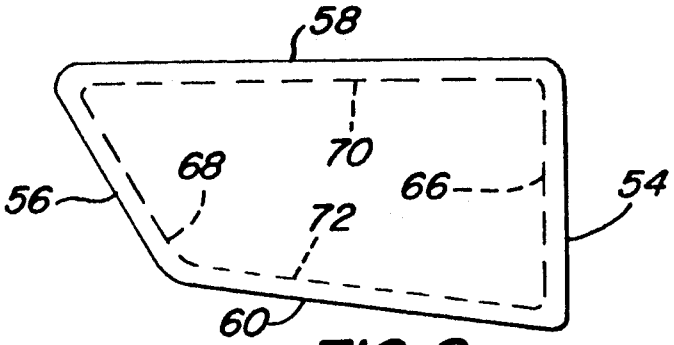
FIG. 8 is an end view of a weighted cover for a driver.
Figure 10:
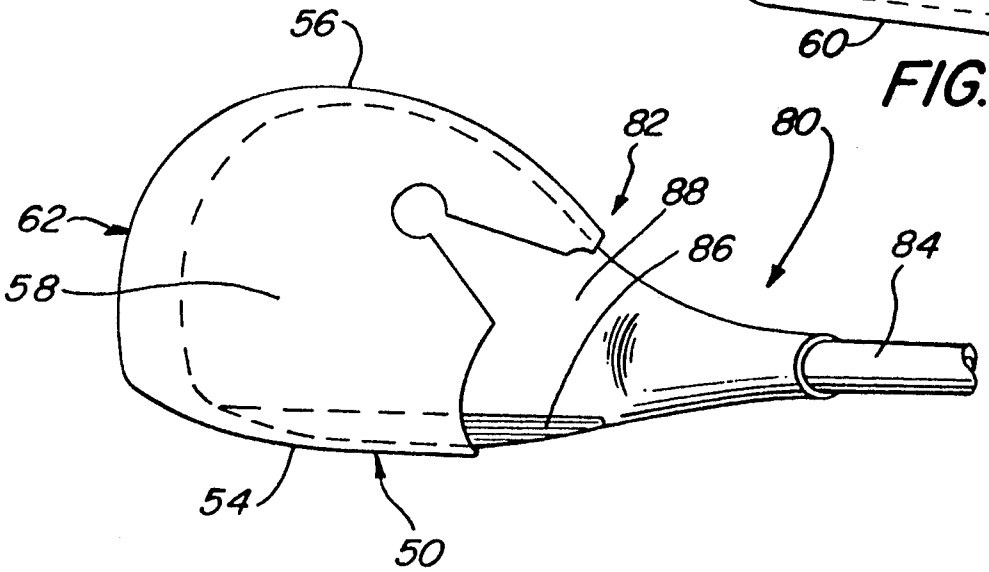
FIG. 10 is a top view of a weighted cover such as in FIGS. 6–9 with a driver being inserted therein.

Weighted driver cover 50 has a driver cover exterior surface 52 and a driver cover interior surface 64. As FIGS. 7 and 8 illustrate, driver cover exterior surface 52 includes driver cover forward exterior surface 54, driver cover rear exterior surface 56, driver cover top exterior surface 58, driver cover bottom exterior surface 60, and driver cover end exterior surface 62. Similarly, driver cover interior surface 64 includes driver cover forward interior surface 66, driver cover rear interior surface 68, driver cover top interior surface 70, driver cover bottom interior surface 72, and driver cover end interior surface 74. FIG. 10 shows golf club driver 80 being inserted into weighted cover 50. Driver 80 includes driver head 82, which is attached to driver shaft 84. Driver head 82, in turn, has a driver hitting surface 86 and driver rear surface 88.

When driver 80 is inserted into driver cover 50, the driver hitting surface 86 abuts driver cover forward interior surface 66. Since the driver rear surface 88 is somewhat curved as compared to its hitting surface 86, driver cover rear interior surface 68 is correspondingly curved to accommodate receipt of driver 80 into driver cover 50.

Figure 6:
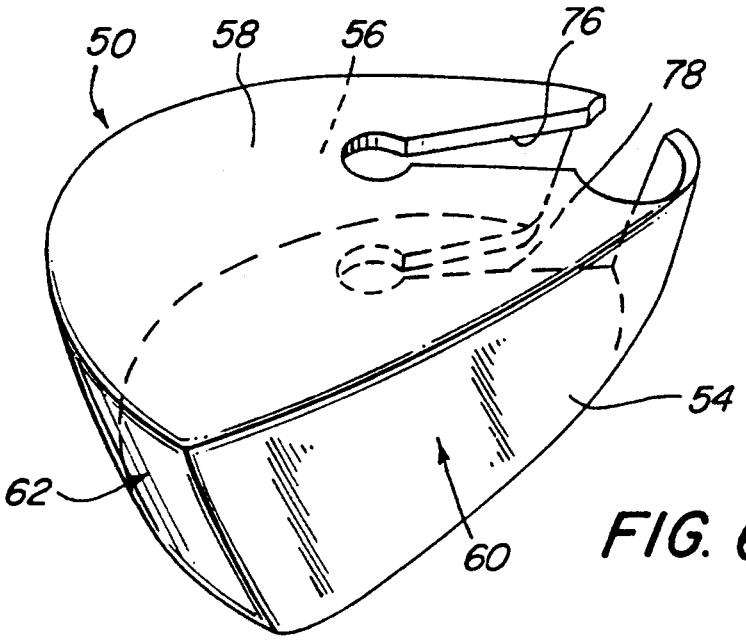
FIG. 6 is a schematic perspective showing a weighted cover for a wood.

Driver cover 50 includes driver cover top slot 76 and driver cover bottom slot 78 which, in combination with the fact that driver cover 50 is preferably made of a flexible material, allows driver 80 to be inserted therein. Top slot 76 is a channel in driver cover 50, as is illustrated in FIGS. 6 and 7. Top slot 76 is bounded by driver cover forward exterior surface 54 and driver cover forward interior surface 66. Similarly, bottom slot 78 is a channel on the opposite side of driver cover 50 and is bounded by driver cover rear exterior surface 56 and driver cover rear interior surface 68. Top slot 76 and bottom slot 78 permit expansion of driver cover 50 during insertion of driver 80 into driver cover 50. Such an expansion of driver cover 50 to receive driver 80 is possible because driver cover 50 is made of a sufficiently flexible material. FIGS. 6 and 7 further illustrate the preferred shape of top slot 76 and bottom slot 78. Such a shape enables weighted driver cover 50 to receive driver 80 and to secure weighted cover 50 to driver 80 during practice swinging.

The materials used to form weighted covers 10 and 50 must render a sufficiently flexible substance, since weighted covers 10, 50 must expand to receive iron head 42 and driver head 82, respectively. Plastics, including thermoplastics and thermosets, are available in forms that are sufficiently flexible to serve as weighted covers 10, 50. Thermoplastics are exemplified by polyolefins such as polyethylene, polypropylene, polyvinylchloride, and ethylene vinyl acetate. Thermoplastics become soft and are easily shaped when heated. Such plastics are formed with additional ingredients, including plasticizers, which increase the plastic's flexibility or workability. In contrast, thermosets, such as polyurethane, become hard when heated and cannot be softened afterwards by further heating.

The density of the aforementioned plastics is typically too low to provide the additional mass desired for weighted covers 10, 50. Filled plastics solve this problem by adding materials that have a higher density than the plastic. Fillers of choice include lead, iron, zinc, barium, aluminum, bronze, stainless steel, or any other compound that is sufficiently dense.

In a preferred embodiment, the plastic of choice is a thermoplastic, preferably a polyolefin such as polyethylene, polypropylene, polyvinylchloride, or ethylene vinyl acetate. A thermosetting plastic such as polyurethane may also be used. As is commonly known in the art, filled plastics are compounds containing some or all of the following components: plasticizers, stabilizers, lubricants, fillers and, perhaps, colorants. Preferred fillers include metals such as lead, iron, zinc, and other compounds of sufficient density.

Injection blow molding, extrusion blow molding, slush casting, and injection molding are the preferred processes by which covers 10, 50 may be formed. Filled polyolefins may be manufactured as described at pages 267–273 of "Plastics in Material and Structural Engineering" by Richard A. Bares, which is incorporated herein by this reference.

The resulting weight of a particular cover 10 or 50 depends upon the respective densities of the plastics and fillers used, the ratio of plastic to filler in the filled plastic, the size of cover 10 or 50, and the thickness of cover 10 or 50. The inventive subject matter contemplated necessarily envisions covers 10, 50 weighing from 2 to 8 ounces each. As some golfers are stronger than others, and because individual preferences differ, weighted covers 10, 50 for any particular golf club, e.g., a nine-iron, may be manufactured in different weights by varying the above-mentioned parameters.

Covers 10, 50 may be manufactured with a particular wall thickness, e.g., a distance between iron cover exterior surface 12 and iron cover interior surface 24, such that the resulting covers 10, 50 have a particular mass and such that the club head's effective center of gravity does not substantially change when the weighted cover is fitted thereon. The contemplated subject matter is readily applicable to golf clubs in as of yet undiscovered head configurations, and also to other athletic equipment that has a center of gravity which is important to the "feel" of the club, racket, paddle, etc.

Since a filled plastic is a substantially uniform mixture of plastic and filler, consistent with the previous discussion, the mass of weighted covers 10, 50 is distributed about the club head in such a manner that the resulting center of gravity of the club head and cover 10 or 50, combined, is essentially the same as the club head's center of gravity alone. The aforementioned center of gravity of the club head, with cover 10 or 50 fitted thereabout, remains substantially unchanged while the golfer utilizes the club for practice swinging, since the weighted cover is securely fitted about the club head.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A weighted golf club cover for receiving a head of a golf club, said weighted cover comprising an exterior surface and an interior surface defining a cavity having an entrance thereto, said interior surface adapted to closely fit over the head of golf club, said weighted cover being composed of a mixture of a plastic and a filler for substantially increasing the density of said plastic so that said cover when fitted over the head of a golf club adds sufficient weight thereto to accelerate the development of golfing muscles in swinging said club with said cover fitted over the head thereof.

2. The weighted cover of claim 1 wherein said plastic is mixed uniformly with said filler.

3. The weighted cover of claim 1 wherein said filler is a metal or inorganic metallic compound.

4. The weighted cover of claim 3 wherein said metal is selected from a group consisting of lead, iron, zinc, barium, aluminum, bronze, or stainless steel.

5. The weighted cover of claim 1 wherein said plastic is a thermoplastic.

6. The weighted cover of claim 5 wherein said thermoplastic is a polyolefin.

7. The weighted cover of claim 6 wherein said polyolefin is selected from a group consisting of polyethylene, polypropylene, polyvinylchloride, and ethylenevinylacetate.

8. The weighted cover of claim 1 wherein said plastic is polyurethane.

9. The weighted cover of claim 1 wherein said plastic is a thermosetting plastic.

10. A weighted golf club cover, for receiving a head of a golf club, said weighted cover comprising an exterior surface and an interior surface defining a cavity having an entrance thereto, said interior surface adapted to closely fit over the head of the golf club, the interior surface including a generally flat forward interior surface for abutting a hitting surface of the golf club and a rounded rear interior surface for abutting a rear surface of the golf club, said cavity being sized to receive the golf club's head and secure the golf club's head against the interior surface, and within the weighted cover, the weighted cover being composed of a mixture including a plastic and a filler for substantially increasing the density of said plastic so that said cover when fitted over the head of a golf club adds sufficient weight thereto to accelerate the development of golfing muscles in swinging said club with said cover fitted over the head thereof.

11. The weighted cover of claim 10 wherein said plastic is selected from a group consisting of polyethylene, polypropylene, polyvinylchloride, ethylene vinyl acetate, and polyurethane.

12. The weighted cover of claim 10 wherein said filler is a metal selected from a group consisting of lead, iron, zinc, barium, aluminum, bronze, or stainless steel.

* * * * *